US010486934B2

(12) United States Patent
Oehrlein

(10) Patent No.: US 10,486,934 B2
(45) Date of Patent: Nov. 26, 2019

(54) SPOOL WINDER

(71) Applicant: Gordon Oehrlein, Elk River, MN (US)

(72) Inventor: Gordon Oehrlein, Elk River, MN (US)

( * ) Notice: Subject to any disclaimer, the term of this patent is extended or adjusted under 35 U.S.C. 154(b) by 119 days.

(21) Appl. No.: 15/730,858

(22) Filed: Oct. 12, 2017

(65) Prior Publication Data

US 2018/0099836 A1 Apr. 12, 2018

Related U.S. Application Data

(60) Provisional application No. 62/407,081, filed on Oct. 12, 2016.

(51) Int. Cl.

| | |
|---|---|
| ***B65H 75/30*** | (2006.01) |
| ***B65H 75/24*** | (2006.01) |
| ***B65H 54/10*** | (2006.01) |
| ***B65H 54/12*** | (2006.01) |
| ***B65H 54/44*** | (2006.01) |
| ***B65H 54/54*** | (2006.01) |

(52) U.S. Cl.

CPC ..... *B65H 75/305* (2013.01); *B65H 54/106* (2013.01); *B65H 54/12* (2013.01); *B65H 54/44* (2013.01); *B65H 54/543* (2013.01); *B65H 75/242* (2013.01); *B65H 75/248* (2013.01)

(58) Field of Classification Search

CPC .. B65H 75/242; B65H 75/248; B65H 75/305; B65H 54/106; B65H 54/12; B65H 54/44; B65H 54/543

See application file for complete search history.

(56) References Cited

U.S. PATENT DOCUMENTS

| | | | |
|---|---|---|---|
| 4,717,086 | A | 1/1988 | Crow |
| 6,254,029 | B1 | 7/2001 | Robertson et al. |
| 6,651,921 | B1 | 11/2003 | Travis |
| 2003/0168546 | A1 | 9/2003 | Bankston |
| 2012/0085855 | A1 | 4/2012 | Mitchell |

*Primary Examiner* — William E Dondero

(74) *Attorney, Agent, or Firm* — Global Intellectual Property Agency, LLC; Daniel Boudwin

(57) ABSTRACT

A spool winder. The spool winder includes a plurality of arms, each having an upper end and a lower end. The plurality of arms are pivotally affixed at the lower end about a rod, wherein the rod can removably secure to a power drill. A notch is disposed on the upper end such that the notch faces the rod, wherein the notch can receive a rim of a spool therein. The spool winder further includes a slide lock having a plurality of apertures therein, wherein the plurality of apertures can receive the plurality of arms therethrough. The plurality of arms can move between a closed position and an open position as the slide lock is moved from the upper end towards the lower end. The distance between the upper end of each of the plurality of arms and the rod is greater when the arms are in the open position.

14 Claims, 5 Drawing Sheets

SPOOL WINDER

CROSS REFERENCE TO RELATED APPLICATIONS

This application claims the benefit of U.S. Provisional Application No. 62/407,081 filed on Oct. 12, 2016. The above identified patent application is herein incorporated by reference in its entirety to provide continuity of disclosure.

BACKGROUND OF THE INVENTION

The present invention relates to spool winders. Specifically, the present invention relates to spool winders capable of securing in a power drill, the spool winder having a plurality of arms having a notch therein for engaging the rim of a spool.

Many people require spools of cord or string, such as for weed trimming devices, however winding these spools by hand can be difficult and frustrating. Additionally, winding a spool by hand can lead to uneven distribution of the string or cord around the spool, preventing the spool from feeding the cord or string properly, potentially leading to a tangled cord which must then be corrected, leading to frustration and inefficiency in using the spool. Known devices provide a power drill attachment for winding fishing line about a spool, however these devices do not include an adjustable attachment capable of securing various sizes of spools therein. Therefore, a device that attaches to a power drill and can wind and unwind differently sized spools is needed.

In light of the devices disclosed in the known art, it is submitted that the present invention substantially diverges in design elements from the known art and consequently it is clear that there is a need in the art for an improvement to existing spool winders. In this regard, the instant invention substantially fulfills these needs.

SUMMARY OF THE INVENTION

In view of the foregoing disadvantages inherent in the known types of spool winders now present in the prior art, the present invention provides a spool winder wherein the same can be utilized for providing convenience for the user when winding a string or flexible cord about a spool.

The present system comprises a plurality of arms, each having an upper end and a lower end, wherein the plurality of arms are pivotally affixed at the lower end about a rod, the rod configured to removably secure within a power drill. A notch is disposed on the upper end of the plurality of arms such that the notch faces the rod, wherein the notch is configured to receive a rim of a spool therein. The spool winder further comprises a slide lock having a plurality of apertures therein, the plurality of apertures configured to receive the plurality of arms therethrough. The slide lock is removably affixed to the rod via a fastener. The plurality of arms are configured to selectively move between a closed position and an open position as the slide lock is moved from the upper end towards the lower end. The linear distance between the upper end and the rod is greater when in the open position. In some embodiments, each of the plurality of arms comprise a C-shaped frame having a notch disposed on opposing sidewalls thereof. In another embodiment, the plurality of arms are pivotally affixed together at the lower ends thereof. In other embodiments, the spool winder further comprises a support member disposed about the rod, wherein the support member includes a plurality of brackets removably secured thereto. In yet another embodiment, the each of the plurality of arms are pivotally affixed to one of the plurality of brackets. In some embodiments, the plurality of arms are disposed equiangularly about the rod. In another embodiment, the spool winder further comprises a plurality of springs, each having a first end and a second end, wherein the first end is affixed to the upper end and the second end is affixed to the slide lock. In other embodiments, the plurality of springs are configured to bias the slide lock towards the upper ends of the plurality of arms. In yet another embodiment, the rod comprises a threaded outer surface. In some embodiments, the fastener comprises a pair of nuts in threaded engagement with the rod, wherein each of the pair of nuts is disposed on opposing sides of the slide lock. In another embodiment, an interior angle of the notch comprises an angle between 60 and 80 degrees. In other embodiments, an interior angle of the notch comprises a 70-degree angle. In yet another embodiment, the slide lock comprises a plate. In some embodiments, the slide lock comprises a C-shaped bracket.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1A:
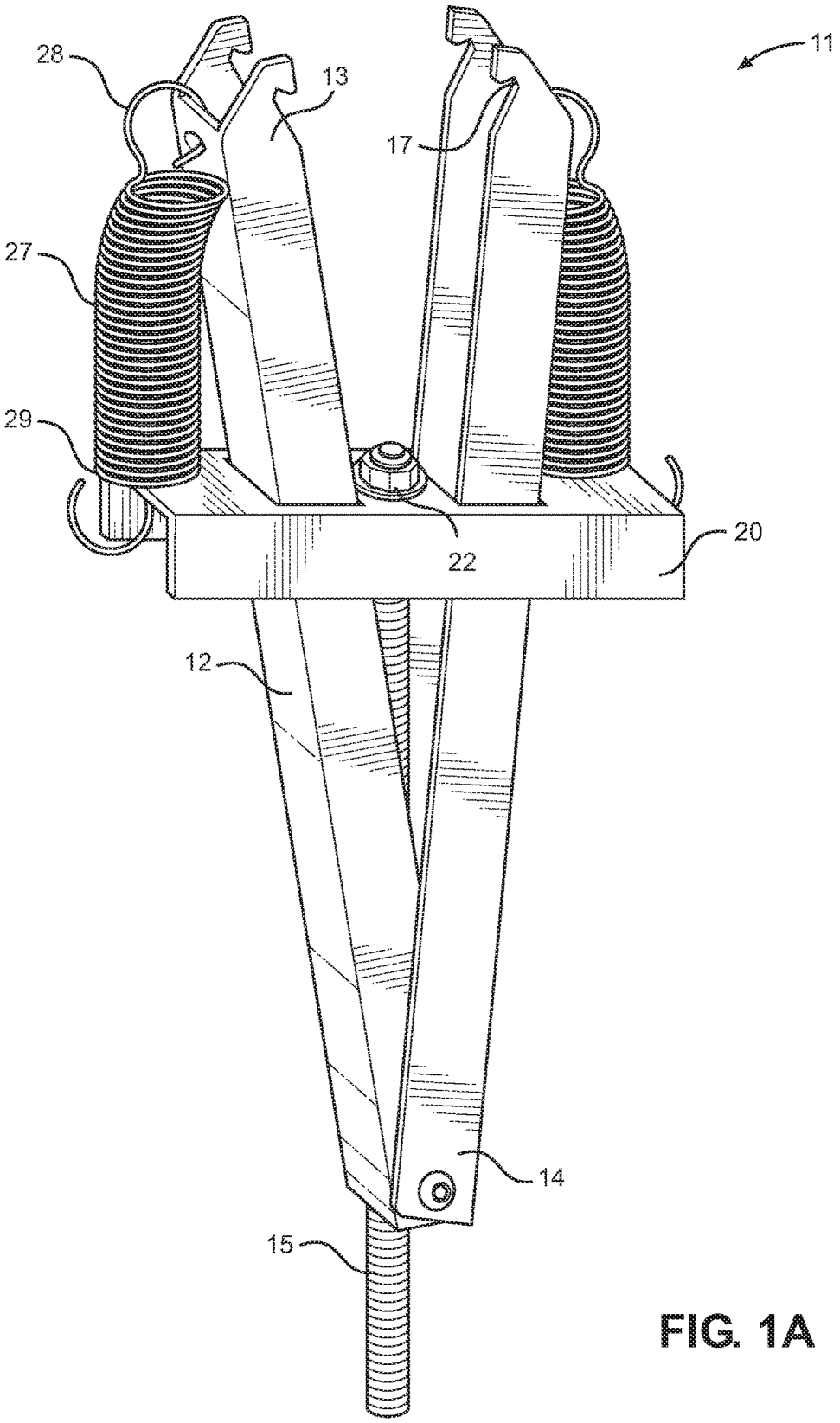
FIG. 1A shows a perspective view of an embodiment of the spool winder.

Reference is made herein to the attached drawings. Like reference numerals are used throughout the drawings to depict like or similar elements of the spool winder. The figures are intended for representative purposes only and should not be considered to be limiting in any respect.

Figure 1B:
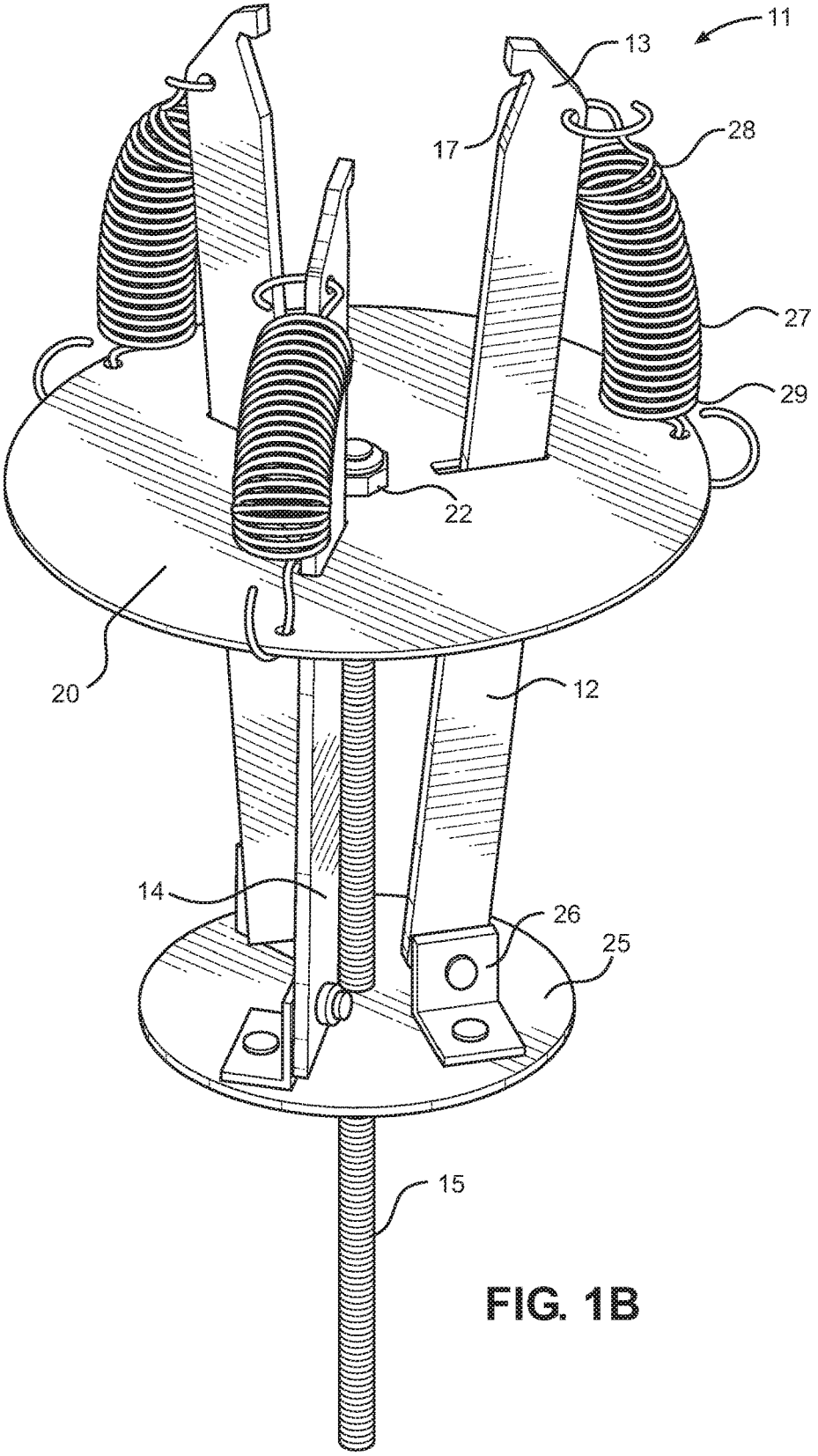
FIG. 1B shows a perspective view of an alternate embodiment of the spool winder.

Referring now to FIGS. 1A and 1B, there is shown a perspective view of an embodiment of the spool winder and a perspective view of an alternate embodiment of the spool winder, respectively. The spool winder 11 comprises a plurality of arms 12 disposed about a rod 15. A notch 17 is disposed within an upper end 13 of the plurality of arms 12. The notch 17 is configured to receive a rim of a spool therein, such that the spool is engaged by each notch 17. In the illustrated embodiment of FIG. 1A, the plurality of arms 12 comprise a pair of C-shaped arms pivotally secured at a lower end 14 thereof. In this embodiment, each of the plurality of arms 12 comprises a pair of notches 17 disposed on opposing sidewalls of the upper end 13. This allows more points of contact between the spool and the plurality of arms 12, increasing stability and further securing the spool therebetween.

In the illustrated embodiment of FIG. 1B, the plurality of arms 12 comprise three planar arms 12 disposed equiangularly about the rod 15. For example, in the illustrated embodiment, the plurality of arms 12 are disposed at 120-degree angles from the rod 15. Additional arms 12 decrease the angle of separation between the arms 12, as the angle is determined by dividing 360-degrees by the number of arms 12. As the arms 12 are equiangularly disposed about the rod 15, a spool secured therebetween within the notches 17 is afforded maximum stability. Additionally, the planar form factor of the arms 12 provide a simple and cost-effective alternative to the C-shaped arms 12 of FIG. 1A, as additional points of contact between notches 17 and the spool are not required for three or more equiangularly disposed arms 12. Further embodiments with greater numbers of arms 12 equiangularly disposed about the rod 15 are also contemplated. In the illustrated embodiment, each of the plurality of arms 12 are pivotally secured to one of a plurality of brackets 26, wherein the brackets 26 are removably secured to a support member 25. The support member 25 is disposed about the rod 15 such that the distance between the upper ends 13 and the top of the rod 15 is sufficient to allow a spool to be placed between the plurality of arms 12.

A slide lock 20 is slidably disposed about the rod 15 and the plurality of arms 12. In the illustrated embodiment of FIG. 1A, the slide lock 20 comprises a C-shaped bracket disposed about the pair of arms 12. The C-shape provides greater strength to the slide lock 20, while also maintaining a minimal form factor, increasing portability and ease of storage of the spool winder 11. In the illustrated embodiment of FIG. 1B, the slide lock 20 comprises a circular plate, however other shapes such as square can be used. In this embodiment, the greater surface area of the slide lock 20 serves to increase the strength of the slide lock 20 in the same way the C-shape does for the embodiment shown in FIG. 1A, allowing a less complex configuration of the slide lock 20. The slide lock 20 is configured to move the plurality of arms 12 between an open position and a closed position as the slide lock 20 is moved along the rod 15. As the slide lock 20 is moved towards the lower end 14, the plurality of arms 12 move towards the open position. The linear distance between the upper end 13 and the rod 15 is greater when the plurality of arms 12 are in the open position. In some embodiments, the slide lock 20, and thereby the position of the plurality of arms 12, can be locked in position by a fastener 22 disposed about the rod 15. In the illustrated embodiments, the rod 15 comprises a threaded outer surface such that the fastener 22 can comprise a pair of nuts in threaded engagement with the rod 15 on opposing sides of the slide lock 20.

A plurality of springs 27 are removably secured to the upper end 13 at a first end 28 of the spring 27 and a slide lock 20 at a second end 29 of the spring 27. The springs 27 are configured to bias the slide lock 20 towards the upper ends 13 when the springs 27 are in an extended position, thereby forcing the upper ends 13 towards the rod 15. This allows a spool to be inserted between the upper ends 13 and securely gripped between the notches 17 as the springs 27 exert a constant force closing the plurality of arms 12 on the spool. In this way, the springs 27 provide additional gripping force to the notches 17, further securing the spool therebetween.

Figure 2:
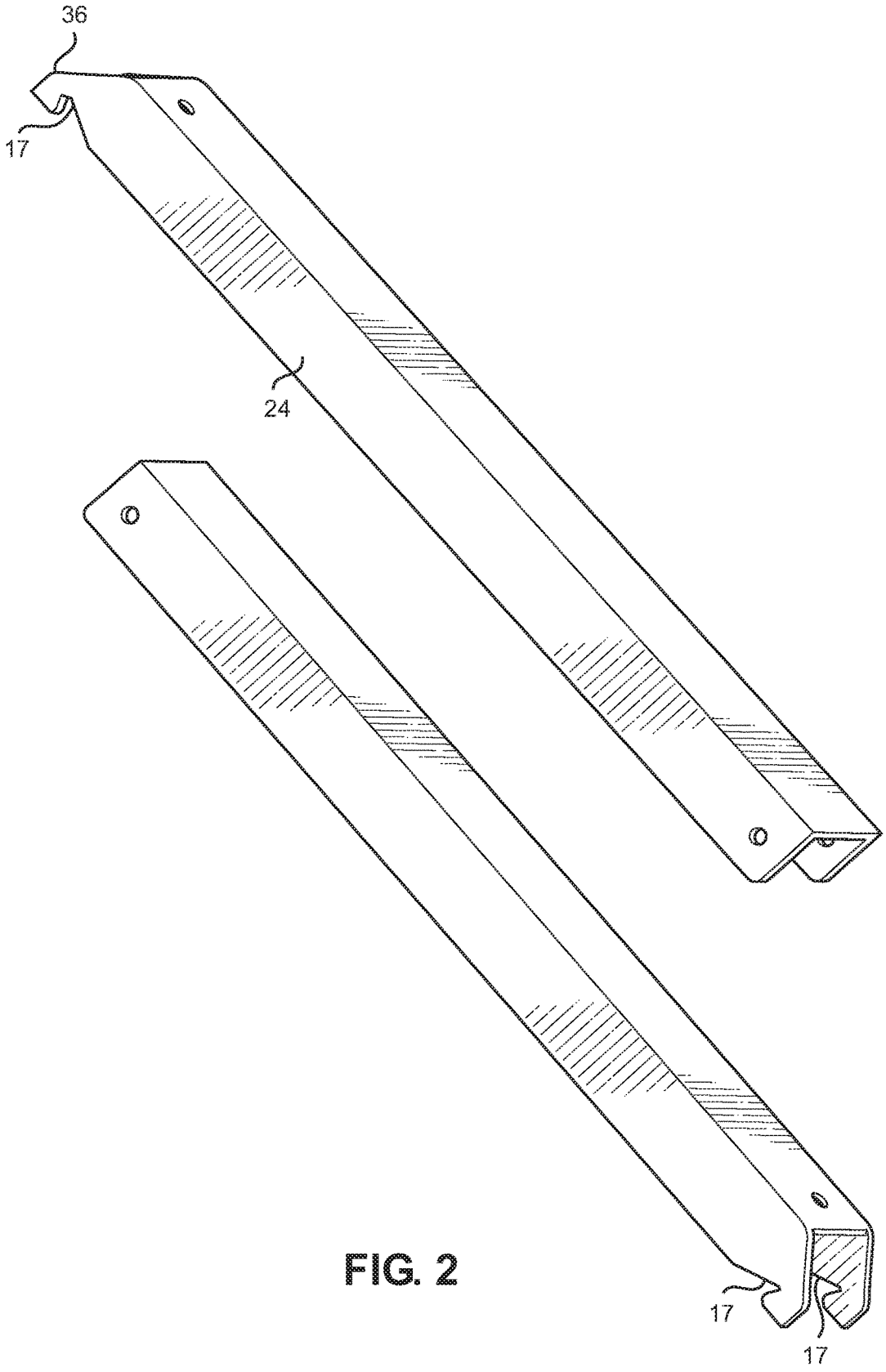
FIG. 2 shows a perspective view of a pair of arms of an embodiment of the spool winder.

Referring now to FIG. 2, there is shown a perspective view of a pair of arms of an embodiment of the spool winder. In the illustrated embodiment, the C-shaped arm 12 of the embodiment shown in FIG. 1A is shown. The C-shaped version of the plurality of arms 12 comprises a pair of opposing sidewalls 24, wherein each of the pair of sidewalls 24 comprises a notch 17 disposed within the upper end. In the illustrated embodiment, the notches 17 comprise a cutout mirroring the shape of a rim of the spool so as to receive the rim flush against the notch 17. The notch 17 creates a protrusion 36 disposed at the upper end of the plurality of arms 12. The protrusion 36 rests upon the spool when the spool is secured within the notches 17. In some embodiments, the notch 17 comprises an interior angle as opposed to the cutout described above. The interior angle comprises an angle between 60 and 80 degrees, which allows the notch 17 to receive the rim of the spool therein.

Figure 3A:
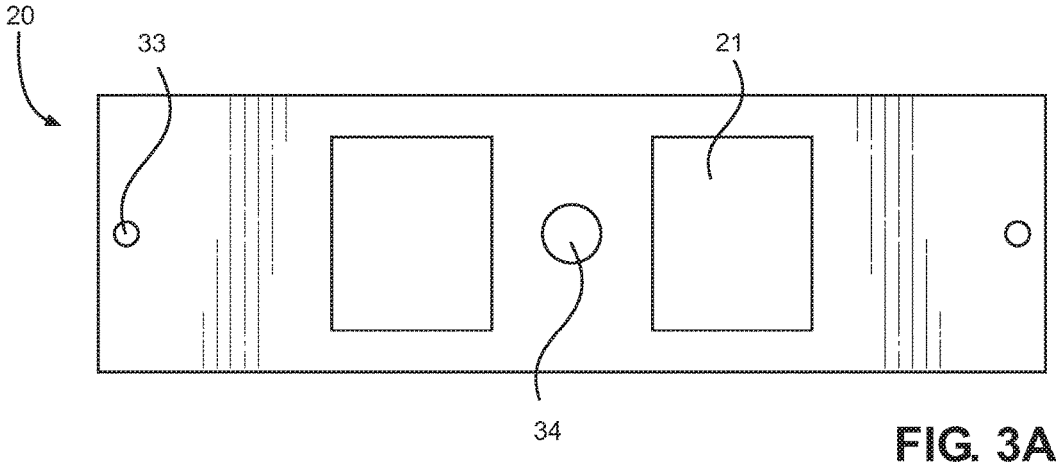
FIG. 3A shows a top-down view of an embodiment of the slide lock of the spool winder.
Figure 3B:
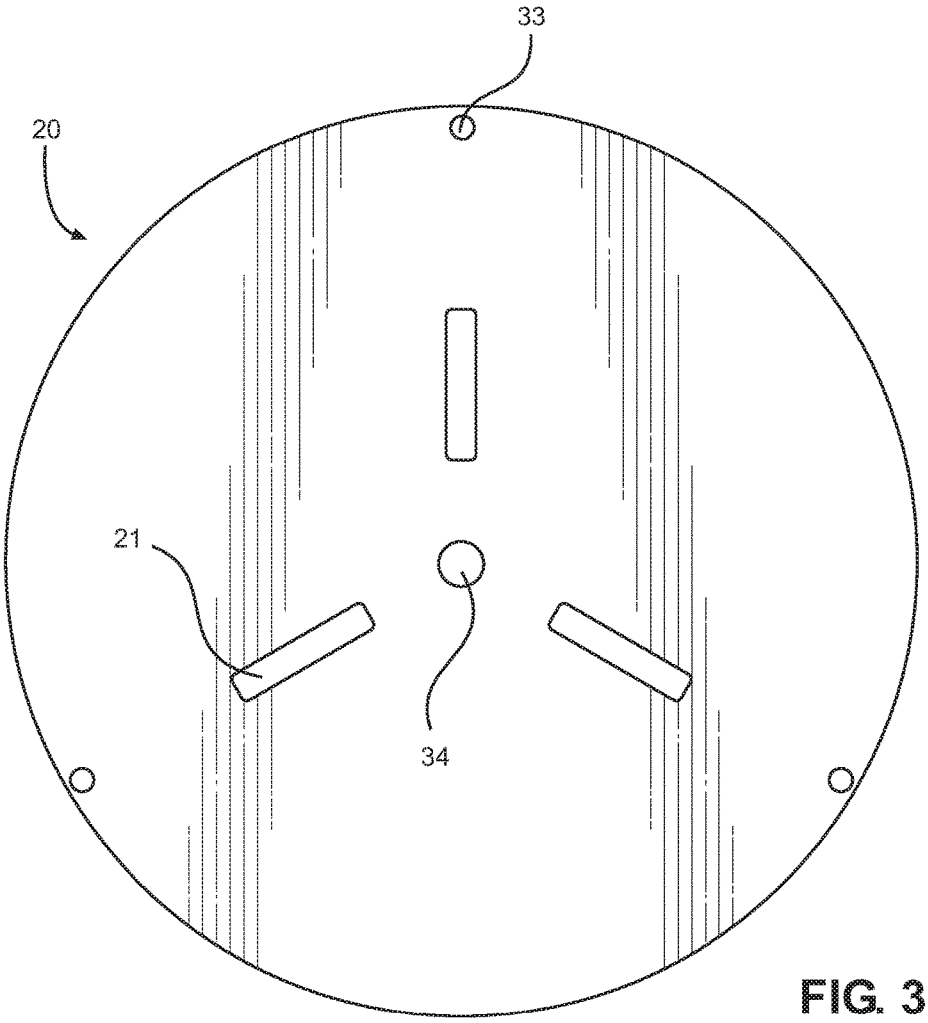
FIG. 3B shows a top-down view of an alternate embodiment of the slide lock of the spool winder.

Referring now to FIGS. 3A and 3B, there is shown a top-down view of an embodiment of the slide lock of the spool winder and a top-down view of an alternate embodiment of the slide lock of the spool winder, respectively. In the illustrated embodiment of FIG. 3A, the slide lock 20 comprises a pair of apertures 21 configured to receive the pair of C-shaped arms of FIG. 1A therethrough. The shape of the apertures 21 force the plurality of arms towards the open position as the slide lock 20 is moved towards the lower end of the plurality of arms. Additionally, the shape of the apertures 21 prevent the arms from rotating within the apertures 21. An opening 34 is centrally disposed on the slide lock 20, wherein the opening 34 is configured to receive the rod therethrough. In the illustrated embodiment, a pair of holes 33 are disposed on opposing ends of the slide lock 20, wherein the pair of holes 33 are configured to removably secure the springs to the slide lock 20. In the illustrated embodiment of FIG. 3B, the apertures 21 are configured to receive the planar arms of FIG. 1B therethrough. Additionally, the holes 33 are disposed adjacent to each of the apertures 21 to allow the springs to removably secure thereto.

Figure 4:
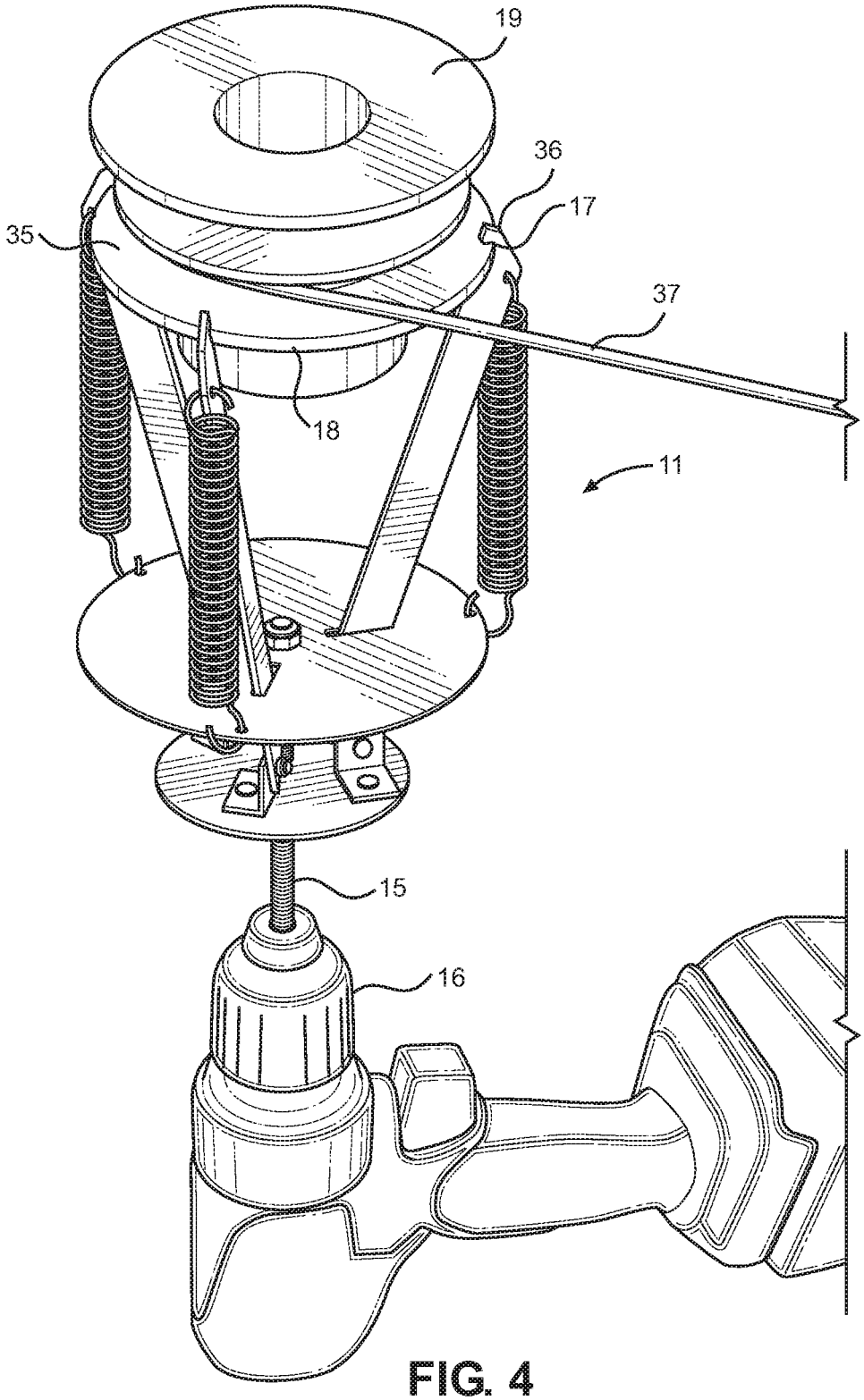
FIG. 4 shows a perspective view of an embodiment of the spool winder holding a spool.

Referring now to FIG. 4, there is shown a perspective view of an embodiment of the spool winder holding a spool. In the illustrated embodiment, a spool 19 is secured between the plurality of arms, within the notches 17. A rim 18 of the spool 19 is received within the notches 17. In some embodiments, the notch 17 rests flush against the rim 18, while in alternate embodiments, the rim 18 is gripped within an interior angle of the notch 17. In the illustrated embodiment, a lower side of the protrusion 36 rests flush against an upper surface 35 of the rim 18 of the spool 19. In one exemplary use, the rod 15 is secured within a power drill 16, such that the rod 15 rotates when the power drill 16 is activated. The spool 19 is then secured within the notches 17. A user can then wind a string 37 about the spool by activating the power drill 16. As the rod 15 rotates, the slide lock rotates with the rod 15, thereby rotating the arms. As the arms rotate, the spool 19 secured within the notches 17 also rotates, allowing the user to wind the string 37 about the spool 19.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A spool winder, comprising:

a plurality of arms, each having an upper end and a lower end;

wherein the plurality of arms are pivotally affixed at the lower end about a rod, the rod configured to removably secure within a power drill;

wherein a notch is disposed in the upper end such that the notch faces the rod, the notch configured to receive a rim of a spool therein;

a slide lock having a plurality of apertures therein, the plurality of apertures configured to receive the plurality of arms therethrough;

wherein the slide lock is removably affixed to the rod via a fastener;

wherein the plurality of arms are configured to selectively move between a closed position and an open position as the slide lock is moved from the upper end towards the lower end;

wherein the linear distance between the upper end of each of the plurality of arms and the rod is greater when in the open position.

2. The spool winder of claim 1, wherein each of the plurality of arms comprise a C-shaped frame having the notch disposed on opposing sidewalls thereof.

3. The spool winder of claim 1, wherein the plurality of arms are pivotally affixed together at the lower ends thereof.

4. The spool winder of claim 1, further comprising a support member disposed about the rod, the support member having a plurality of brackets removably secured thereto.

5. The spool winder of claim 4, wherein each of the plurality of arms are pivotally affixed to one of the plurality of brackets.

6. The spool winder of claim 1, wherein the plurality of arms are disposed equiangularly about the rod.

7. The spool winder of claim 1, further comprising a plurality of springs, each having a first end and a second end, wherein the first end is affixed to the upper end and the second end is affixed to the slide lock.

8. The spool winder of claim 7, wherein the plurality of springs are configured to bias the slide lock towards the upper end of the plurality of arms.

9. The spool winder of claim 1, wherein the rod comprises a threaded outer surface.

10. The spool winder of claim 9, wherein the fastener comprises a pair of nuts in threaded engagement with the rod, wherein each of the pair of nuts is disposed on opposing sides of the slide lock.

11. The spool winder of claim 1, wherein an interior angle of the notch comprises an angle between 60 and 80 degrees.

12. The spool winder of claim 11, wherein an interior angle of the notch comprises a 70-degree angle.

13. The spool winder of claim 1, wherein the slide lock comprises a plate.

14. The spool winder of claim 1, wherein the slide lock comprises a C-shaped bracket.

* * * * *